US005500020A

United States Patent [19]

Bandino

[11] Patent Number: 5,500,020

[45] Date of Patent: Mar. 19, 1996

[54] PROCESS FOR TITANIUM-BASED MIXED TANNINGS

[76] Inventor: Giacomo Bandino, 2 Glencove Rd., Morris Plains, N.J. 07950

[21] Appl. No.: 447,681

[22] Filed: May 23, 1995

Related U.S. Application Data

[63] Continuation of Ser. No. 137,500, Oct. 15, 1993, abandoned.

[51] Int. Cl.[6] ..... C14C 3/04

[52] U.S. Cl. ..... 8/94.22; 8/94.21; 8/94.2; 8/94.25; 8/94.26; 252/8.57

[58] Field of Search ..... 8/94.2, 94.21, 8/94.22, 94.24, 94.25, 94.26; 252/8.57

[56] References Cited

U.S. PATENT DOCUMENTS

| | | | |
|---|---|---|---|
| 1,774,626 | 9/1930 | Allen et al. | 8/94.2 |
| 3,938,951 | 2/1976 | Motov et al. | 8/94.25 |
| 4,560,384 | 12/1985 | Vanni et al. | 8/94.25 |
| 4,960,429 | 10/1990 | Colom et al. | 8/94.26 |
| 4,963,156 | 10/1990 | Hinley | 8/94.29 |

FOREIGN PATENT DOCUMENTS

| | | |
|---|---|---|
| 3903499 | 8/1989 | Germany . |
| 3929366 | 3/1990 | Germany . |
| 2004445 | 1/1989 | Spain . |
| 2004940 | 2/1989 | Spain . |
| 2004941 | 2/1989 | Spain . |
| 2009394 | 9/1989 | Spain . |
| 425201 | 3/1935 | United Kingdom . |
| 2165859 | 4/1986 | United Kingdom . |

OTHER PUBLICATIONS

Ullman's Encyclopedia of Industrial Chemistry, vol. A15, 1990,* 274–277.

*Primary Examiner*—Prince Willis, Jr.
*Assistant Examiner*—Alan D. Diamond
*Attorney, Agent, or Firm*—McGlew and Tuttle

[57] ABSTRACT

The tanning of skins is carried out using a titanium-based compound in a percentage of 5% to 10% and especially of 6% with respect to the pelt weight of the skins; a washing treatment is carried out between a basification phase and a further tanning phase; in said washing phase a sodium (or potassium) salt is introduced in the dry state prior to the water.

22 Claims, 1 Drawing Sheet

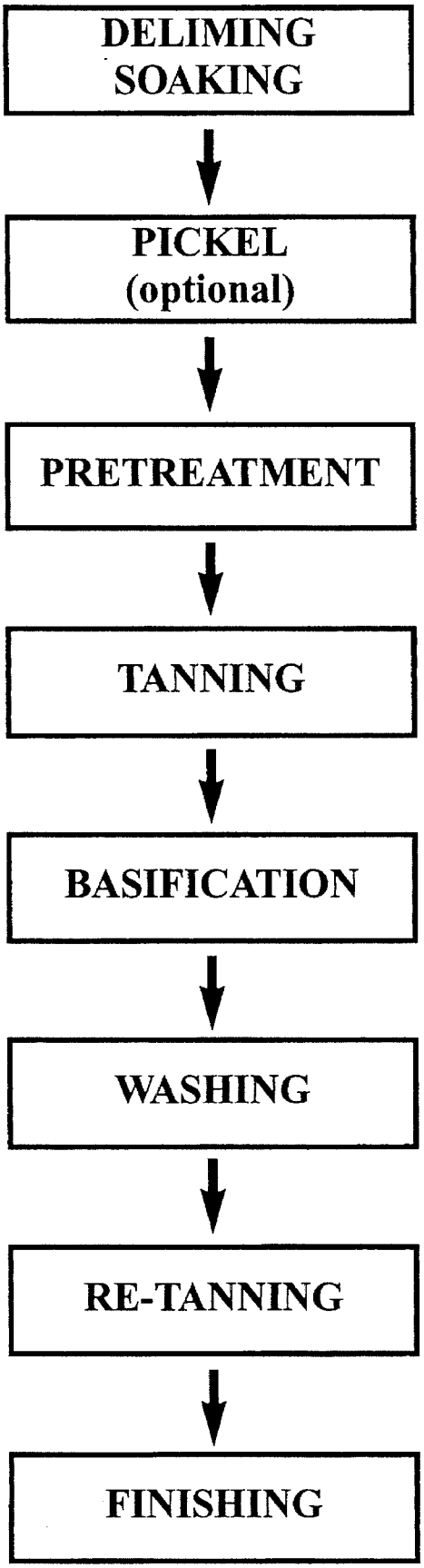
DELIMING
SOAKING
PICKEL
(optional)
PRETREATMENT
TANNING
BASIFICATION
WASHING
RE-TANNING
FINISHING

PROCESS FOR TITANIUM-BASED MIXED TANNINGS

This is a file wrapper continuation of application Ser. No. 08/137,500 filed Oct. 15, 1993, now abandoned.

The invention relates to a titanium tanning process by which a very satisfactory finished product is produced without the use of chromium, but using titanium salts in combination with other substances and succeeding in guaranteeing the optimal quality of the results.

By way of literature which defines the prior art, the following documents may be cited:

1) Patents of Soviet origin: USSR Applications No.2831651 and No.2831652 of 1979; see also Patents: East Germany 0154105; Luxemburg 83359; Australia 534,205; Netherlands 176,375; Belgium 888,759; inventors Motov—Tjurkina—Yakusheva et al.; relating to the production of the tanning substance and to its application to leather for soles and skins;
2) British Patent No.2,165,859 Covington; relating to the use of the Ti/Al mixture in the presence of polyhydroxycarboxylic masking agents for the production of skins with hair;
3) Spanish Patents No.2,004,941, No.2,004,445 and No.2,004,940 Celades, relating to the use of weak organic masking agents with titanium activation for the preservation of skins;
4) German Patent No.3,003,499 Hinley et al (Tioxide), relating to the use of the Ti/Al mixture in combination with polyhydroxycarboxylic masking agents;
5) German Patent No.3,929,366 Bach et al (Simontornyai Borgyar—Hungary), relating to the use of all vegetable and synthetic tanning substances in combination with Al, Zr and Ti for the production of Soft skins;
6) Spanish Patent No.2,009,394 Celades, relating to the use of polymers and of polyhydrocarboxylic acids in combination with titanium for the production of skins.

This invention relates to a particular tanning process which utilizes a particular sequence of treatment for the purpose of forming a finished soft skin using titanium salts. It is known from the literature that it is possible to tan using titanium, but it is also known that the disadvantages are considerable and that they are due, on the one hand, to the chemical nature of titanium (which easily undergoes hydrolysis) and, on the other hand, to the steric hindrance of said titanium which imparts to the finished products a rigidity which is so great as to make the products unsaleable.

In contrast to this, the present invention is directed to forming a soft skin and, to do this, use is made of a mixed tanning which uses, in combination with the conventional tanning agent which is ammonium titanium double sulfate, both polyphosphates and oils and masked aldehyde function products—recently introduced onto the tanning market—as well as, furthermore, titanium coadjuvant products known under the name of masking agents and which exhibit, in general, carboxylic functional groups which are capable of complexing said titanium.

In substance, the present tanning process provides: that the tanning is carried out using a titanium-based compound in a percentage of 5% to 10% with respect to the pelt weight of the skins; that a washing treatment is carried out between a basification phase and a re-tanning phase; and that in said washing phase a sodium (or potassium) salt is introduced in the dry state prior to the water.

In practice, the titanium-based compound is used in a percentage of approximately 6%.

Said titanium-based compound is advantageously an ammonium titanium double sulfate monohydrate.

A sulfate or a chloride or an organic anion can be used as the sodium—or potassium—salt; the salt of the organic anion is in the presence of its weak acid.

In one and the same container—such as a drum there are performed in succession on the delimed and soaked skins the operations of pickel, of pretreatment, of tanning and of basification; then, the product is extracted and is maintained in stasis for a period of time in the order of 30–50 hours and is then treated with the salt in an anhydrous environment and thereafter subjected to washing.

The pretreatment may be carried out using a nonmetallic tanning agent, and especially with the presence of citric acid, sodium sulfate and phosphoric esters of long-chain oils. For the pretreatment it is possible to use an oxazolidine, and in particular 7a-ethyldihydro-1H,3H,5H-oxazole (3,4) oxazole commercially known under the name Granofin A (or zoldine ZE).

The tanning is preferably carried out in a bath at a pH of approximately 1.0 to 1.3 and especially approximately 1.1 to 1.2.

In the present process, the basification is preferably carried out initially at a pH within the range between 2.7 and 2.9 and subsequently at a pH within the range between 3.2 and 4.0 with addition of sodium formate or equivalent in the final step.

In the pretreatment and/or in the basification, it is possible to use a sodium salt of a weak monocarboxylic, dicarboxylic or polycarboxylic acid, in order to avoid or to limit the separation of the titanium in the form of hydroxide.

In a practical embodiment, the present tanning process, using a titanium-based treatment, comprises the phases of:

deliming and soaking;

pickel with buffer salts in strong acids and/or sulfonic or dicarboxylic organic acids;

pretreatment with: oily products selected from cationic agents, sulfochlorides, phosphoric esters; oxazolidines; tanning products selected from metallic tanning agents, synthetic tanning agents, polymer resins; organic anhydrides; masking products selected from citric acid, polyphosphates and monocarboxylic, dicarboxylic and polycarboxylic organic acids;

tanning, with ammonium titanyl double sulfate monohydrate in a quantity within the range between 5% and 10%, and especially 6% with respect to the weight of the pelt skin, possibly in combination with the substances of the pretreatment, at a pH within the range between 1.0 and 1.3 and especially between 1.1 and 1.2;

basification, at a pH within the range between 2.7 and 2.9, with magnesium oxide and/or ion exchange resins and/or dolomite;

stasis for approximately 30–50 hours;

treatment, in the dry state, with sodium chloride and/or sodium formate and/or buffer of organic acids;

washing with water;

re-tanning, using metallic tanning agents and/or synthetic tanning agents and/or vegetable tanning agents and/or oxazolidines;

finishing by a conventional method.

The principal innovations within the scope of the present invention are the following:

the sequence of application of the products;

the narrow conditions of pH, of concentration and of temperature within the drums;

the introduction of narrow controls during the tanning phases, which has permitted the continuous observation of all the phases of attack and of penetration by the titanium into the skin and the ability to exercise control over the same from the outside as a function of the result aimed at;

the elimination of all the phases of washings, with consequent reduction of the saline discharges.

The primary objective of the present application study was to obtain a semifinished product WET-WHITE, which would have a sufficient stability and which, in the course of the subsequent re-tanning operations aimed at obtaining different kinds of products on the basis of the specific requirement of the market, would give finished skins of the same quality as, if not of superior quality too, those obtained from WET-BLUE or from semifinished products using other tanning systems; accordingly, what was produced was a white product having a shrinking or gelation temperature Tg within the range between 75° and 88° C., and which then, in the course of the successive processings, gave the desired results, that is to say skins having a Tg of 95°–100° C. depending upon the tanning system, and having high resistance to tearing and to bursting.

The extensive literature preceding the devising of the present invention has demonstrated the tendency of titanium to form bonds with the carboxyl groups of the available proteins in the animal derma, without involving the other functional groups such as the terminal amino groups and the amido groups of the peptide bond, and the tendency that these groups in their turn, in order to be tanned, require the introduction of appropriate substances such as oils and oxazolidines which are capable of reacting by means of condensation reactions and formation of covalent bonds.

Nevertheless, according to the invention, it has been found—following experiments—that, even after tanning with titanium, many carboxyl groups remain exposed and that, in terms of possibility, a tanning using mixed salts, which would involve (excluding chromium, on account of pollution problems) metal salts of aluminum and zirconium should not be ruled out.

Finally, an assessment was also made of the possibility of tanning using only titanium salts; in this case, the means to be employed are related to the presence of masking agents which may permit the regulation of the reactivity of the titanium and the determination of the penetration thereof depending upon the requirements.

BRIEF DESCRIPTION OF THE DRAWING

The accompanying drawing describes, step by step, the operations of the instant process.

DESCRIPTION OF THE EXPERIMENTAL SECTION

The process described hereinbelow refers to delimed skins which have already undergone a soaking performed in accordance with the conventional procedure. Accordingly, these have already undergone a partial depolymerization of the collagen. This may be followed by referring to the flowsheet of the accompanying drawing, which identifies—step by step—all the operations which must be performed.

Pickel

The tanning operation begins with a pickel; this is performed for the purpose of bringing the operative pH to the vicinity of a value of slightly less than 3; in fact, conventionally, use is made of strong acids containing various saline mixtures. In the case of the present invention, this is done by forming, under suitable conditions, a mixture which may contain water, sodium chloride, formic acid or, in general, monosulfonic and polysulfonic, monocarboxylic and polycarboxylic organic acids as well as their derivatives which, in a sulfuric acid medium, are capable of making the acid function and sulfuric acid free; the quantities—which vary between 0.5 and 5.0% with respect to the weight of the pelt skins—are related to what is formed subsequently, to the temperatures and to the dwell times of the skins in this medium. The parameter which must be stringently followed in the first phase of control of the pickel is the "acid swelling"; this is due to a complex phenomenon of hydrolysis which takes place on the peptide chains even before these are tanned, causing irremediable damage; in order to avoid such acid swelling, the reaction mixture in this first phase must have a density of 1.0432–1.0507 g/cm$^3$.

Pretreatment

The phase subsequent to the pickel is a pretreatment phase which has many purposes.

The first of these purposes is to prepare the substrate for the introduction of the tanning agent; this is carried out by introducing so-called "masking" substances which are capable of forming bonds with the titanium when the latter is added, which will have the effect of promoting the establishment of a dynamic equilibrium between the reaction bulk and the layer of skin which is being tanned. The masking substances which have been experimentally tested within the scope of the present invention are of already known application, but the sequence in which these were employed constitutes an important key for the purpose of carrying out a process which gives results superior to all those already in use and is strictly the subject of the present invention. The most widely used of said "masking" substances is citric acid or its salts, but other possibilities are lactic, oxalic, tartaric, succinic, gluconic, galactonic and lactobionic acids and all the organic acids derived from the oxidation of monosaccharide, disaccharide and polysaccharide sugars, i.e. the class of compounds which, through the carboxyl function, can complex the titanium under the required operational conditions; clearly, it is also possible to use the hydroxy, amino and anhydride derivatives of these which, in the specific reaction medium, are capable of liberating the acid function which is necessary. Moreover, among the masking agents, it is also possible to use the polyphosphates, making sure that their basicity does not excessively influence the subsequent operation, since it is necessary to optimize the conditions of pickel in terms of acid, if it is decided to use the polyphosphates in the pretreatment phase; of course, this also applies to all those derivatives which require additional acidity in order to form the free carboxyl group.

Another primary objective of the pretreatment is to initiate the tanning, proceeding to involve those groups of bonds which, upon titanium attack, remain inert and thus, in general, the groups containing nitrogen; to this end, use is made of species which bond to terminal amino groups such as oxazolidines, as well as oils of the cationic type or sulfochlorides or phosphoric esters, which bond to the peptide NH and also have the capacity to provide a greasing of the skin even during these operations.

The controls which are undertaken during the pretreatment relate only to times and temperatures, provided that there is certainty as to the concentrations of the reagents employed, for such concentrations constitute fundamental parameters for the subsequent reactivity of the titanium; use is made of concentrations varying from 0.3% to 4.0% with respect to the pelt weight.

Tanning with titanium

The phase subsequent to the pretreatment is the tanning phase, in which salification takes place of the carboxyl groups or of a proportion of them. This is carried out using titanium salts. Among the titanium salts which have been used, the one which has given the best results is ammonium titanyl double sulfate monohydrate, already produced in accordance with a method set forth in the aforementioned monopoly rights in the name of David Lazarevich Motov, Tjiurkina Ljiudmila Petrovna et al., even though other crude salts such as the mineral ilmenite or the Ti/Al complex used with the procedure of the invention have given equally good results. In this phase, what is created in physical terms is a continuous exchange dynamic equilibrium between the solution and the skin layer involved in the tanning; there is a chemical phenomenon of dynamic distribution between the phases, which should not lead to the saturation of the carboxyl bonds. When using titanium, in contrast to what takes place with chromium, the saturation of the carboxyl bonds, if reached at all, would lead to extremely hard skins, of the hide type, on account of the greater magnitude of its ion radius. Thus, in the tests which were carried out optimization took place of the titanium salt concentration at about 6% with respect to the weight of the pelt skin.

During the phase of optimization of the process, an assessment was also made of the possibility of not carrying out the pretreatment, but of using the various reagents directly in combination with the tanning agent; this gave similarly good results. This may be explained in terms of reactivity of the titanium for which it is sufficient to provide, at the concentrations indicated according to the invention, the presence, in the bulk of the solution as well, of the masking agents; furthermore, the other substances do not interfere at all with the titanium, since they involve spheres of reactivity which are entirely different.

In this same phase, a bactericidal treatment is carried out, which permits, once the tanning phase has been completed, the preservation of the "wet-white" obtained for a certain number of days, without any alterations being suffered.

The type of control which is undertaken at this very delicate point in the operation is to evaluate the quantity of titanium which has penetrated into the section of the skin, its pH, the total titanium concentration and the presence or absence of titanium in the form of hydroxide in the tanning bath. If the parameters are within the limits as set forth in Example 1, it is possible to be sure of having achieved a reactivity for the carboxyl groups which is sufficient to guarantee an effective tanning. Other metals tanning the carboxyl groups, such as aluminum or zirconium, may be introduced in this phase, in the pretreatment or, in the final analysis, during re-tanning.

Basification

The operation of tanning, understood as final fixing of the titanium binder to the protein substrate of the animal derma, takes place at the time of the basification, when the distribution equilibrium is interrupted, and, depending upon the pH, formation takes place of a stable species which is crosslinked between the proteins and the titanium. The basification must be carried out under the most stringent control because if the basification conditions indicated in the examples were not complied with, this being the strict subject matter of this invention, all the preceding operations would be frustrated: in order to perform a basification which then gives a tanned skin having a high shrinking temperature, it is necessary to provide basicity at such a rate as not to permit the formation of hydroxide from the acid bath and from the solution which is absorbed by the skin, but which nevertheless permits attainment of 3.5 with a uniform distribution of titanium in the skins and with all the titanium provided being fixed to the proteins. The rate of alkalization was optimized in terms of the rate of addition of the basifying agent in relation to the pH at the end of the tanning operation and to the operating temperature; the lower the pH and the higher the temperature, the slower must be the basification. The parameters are set forth in Example 1. Among the basifying agents, those which have proved to be the most effective are those which dissolve slowly, such as magnesium oxide or the weakly basic ion exchange resins or alternatively those in combination with buffers of organic acids such as acetates, formates, oxalates etc., which are nevertheless capable of creating a slow pH gradient in the system.

At the end of the basification operation, what is obtained is the "wet-white" based on titanium, i.e. a tanned skin having a Tg of approximately 80° C., treated entirely with nontoxic material; this may be reprocessed in various ways according to the articles which it is desired to obtain; it constitutes an excellent starting point for any type of subsequent processing for the production of footwear, skins for clothing, for furnishings and for handbags and sundry accessories.

The "wet-white" must necessarily be stored for at least 48 h stationary in a humid environment; this involves a further diffusion of the titanium through the layer of skin and the formation of an improved crosslinking due to the formation of large complex agglomerates containing a plurality of titanium molecules and various protein molecules.

After or during this storage phase, the skins are processed, i.e. sammed so as to remove all the water of the bath, and then selected and shaved in accordance with the conventional procedure. The shavings are reused or disposed of; the split is used in low quality applications, and the grain is subjected to subsequent processings.

Re-tanning

The subsequent processing is known under the name of re-tanning; the subject matter of the present invention includes the discovery of a very effective way of performing re-tanning which permits the production of finished products having qualities comparable with those of products produced using chromium. The parameters and the operational procedures which have been developed in this invention constitute an interpretative key for all the parameters optimized in the preceding phases; furthermore, they become conditions which are stringently necessary for the production of tanned skin whose quality exceeds all those described in the earlier literature.

After the shaving operation, the skin is at a pH of 3.3–3.5; the fixing of the tanning agents has already taken place at this value, and conventionally the skin is subsequently reprocessed in a re-tanning operation, after it has been brought to suitable pH conditions by washing. The type of re-tanning which will be performed takes account of the type of finished product which it is desired to produce, and it is possible to use chromium salts, oils, vegetable and synthetic tannins, aldehydes, zirconium salts, aluminum salts and again titanium salts.

The conditions of this washing in a dry state which precedes the tanning—as developed in this invention, are critical to the avoiding of "acid swelling" and of obtaining a finished skin with high mechanical strength; the sammed and shaved skin is treated, before the addition of water, with a mixture of salts which may be either inorganic, for example sodium chloride, or organic, such as formates, citrates, or in general any systems consisting of a weak organic acid in the presence of its salt and of mixtures thereof; after the presence has been guaranteed, in the drum, of those salts which are capable of achieving, following the addition of water, a density of 1.043 g/cm$^3$ and a pH of 4.5–5.5, the washing properly so-called is carried out using a quantity of water (see Example 1) such as to be completely absorbed by the previously sammed skins.

Examples of application of the invention are reported hereinbelow.

EXAMPLE 1

The percentages of substances added are to be understood as being related to the weight of the pelt skins, i.e. skins which have been limed and fleshed. The operations are carried out on skins which have been delimed and soaked according to conventional methods.

Pickel:

The following are added to the drum containing the delimed and soaked skins:

100% water

10% sodium chloride and the reaction mixture is maintained at 20° C. for 20 minutes under mechanical agitation; a density control is performed, which must be approximately 1.0545–1.0584 g/cm$^3$.

The following is then added to the same drum:

Formic acid (1:10) 0.8% while still maintaining the reaction mixture at 20° C. for 60 minutes; the following is then added:

Sulfuric acid 85% (1:10) 1.4% maintaining the mixture under mechanical agitation for 4 hours (h) and then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$.

Pretreatment:

In the same drum in which the pickel was carried out, the pretreatment is carried out by adding, still at 20° C.:

Anhydrous citric acid 0.5%

Anhydrous sodium sulfate 0.5%

Seritol 82 1% (Seritol 82=synthetic oil obtained from long-chain phosphoric esters—Hyspano Quimica) and maintaining the mixture under mechanical agitation for 20 minutes; when this period of time has elapsed, the tanning is carried out. The control which is performed at this stage is a temperature control, as the temperature becomes a parameter which is fundamental to the reactivity of the tanning agent and of the neutralizing agents which are added in the subsequent operations; this temperature must be approximately 20° C.; if this value is exceeded, the reagents must be modified in proportion, as set forth in Example No.11. Likewise, if the pH in the pickel is lower for any reason.

Tanning

The following are added to the same drum:

Ammonium titanyl double sulfate monohydrate 6%

Detagil CT 0.1% (Detagil CT=5% thiocyanomethylthiobenzothiazol) maintaining the mixture for 3 h under mechanical agitation; when this period of time has elapsed, the following controls are performed:

pH in the bath: 1.1.–1.2;

presence of titanium in skin section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, fixing is undertaken.

Basification

The following are added in two successive portions, again to the same drum:

Mg oxide 0.21%

Anhydrous citric acid 0.03%

Sodium formate 0.06% maintaining the first portion in agitation for two hours and the second, in the same quantity, for three hours.

When this period of time has elapsed, the following controls are performed:

pH of the bath: 2.8–2.9;

absence of precipitates in the bath (visual inspection);

absence of titanium in the form of Ti(+4) in the bath (coloration with hydrogen peroxide).

The following is then added:

Sodium formate 0.5% maintaining the mixture under mechanical agitation for 4 h, then at rest for 10 h; this period of time is followed by determination of pH, which must be approximately 3.3–3.5, and the detection of a uniform coloration with hydrogen peroxide throughout the cross section of the skin; then the drum is discharged and the "wet-white" skins are maintained undisturbed in a humid environment for at least 48 h. After this period of time, the skins are sammed, divided and shaved, giving rise to a "grain" which has a pH of approximately 3.5 which is intended for the subsequent re-tanning operations.

Washing

The percentages are to be understood as being related to the shaved skin. The shaved skins are loaded into a drum, and the following are added at a temperature of 20° C.:

Anhydrous sodium sulfate 0.24%

Sodium formate 0.03%

Anhydrous citric acid 0.03% maintaining the mixture in agitation for 5 minutes, and then the following is added:

Water 200% maintaining the mixture in agitation for 20 minutes.

The control which is performed at this point is a density control, which must be 1.0432 g/cm$^3$ and a pH control which must be within the range between 3.4 and 3.6.

Re-tanning

This phase is to be understood as referring to all the operations of re-tanning, including also the treatments which must be undertaken prior to supplying the tanning agent proper. The subject matter of the present invention does not include the devising of the re-tanning; what can be stated is that all the re-tanning processes have been tested from this phase on, which processes gave all the results hoped for; the skins which are obtained all have high mechanical strength, a shrinking temperature of 80°–100° C. depending upon the systems employed, and very great softness.

EXAMPLE 2

Pickel:

The following are added to the drum containing the delimed and soaked skins:

Water 100%

Sodium chloride 10% and the mixture is maintained at 20° C. for 20 minutes under mechanical agitation; a density control is performed, which must be approximately 1.0545–1.0584 g/cm$^3$.

The following is then added, in the same drum:

Sulfuric acid 85% (1:10) 1.8% still maintaining the mixture at 20° C. under mechanical agitation for 4 h, and then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$.

Pretreatment

In the same drum in which the pickel was carried out, the pretreatment is carried out by adding, still at 20° C., the following:

Anhydrous citric acid 0.5%

Anhydrous sodium sulfate 0.5%

Seritol 82 1%

Granofin A 1-3% (Granofin A=7a-ethyldihydro-1H,3H,5H-oxazole (3,4) oxazole, 100%, from Hoechst) and maintaining the mixture under mechanical agitation for 30 minutes; when this period of time has elapsed, the tanning is carried out. The control which is performed at this stage is a pH control and, in fact, the following is added:

Sulfuric acid 85% to a pH value of 2.6–2.9. The mixture is still maintained under agitation for 30 minutes at 20° C.

All the other operations are carried out as set forth in Example 1.

EXAMPLE 3

Pickel:

The following is added to the drum containing the delimed and soaked skins:

Water 100%

Sodium chloride 10% and the mixture is maintained at 20° C. for 20 minutes under mechanical agitation; a density control is performed, which must be approximately 1.0545–1.0584 g/cm$^3$.

The following are then added, in the same drum:

Anhydrous citric acid 1%

Anhydrous sodium sulfate 1% still maintaining the mixture at 20° C. for 60 minutes, and then the following is added:

Sulfuric acid 85% (1:10) 1.6% maintaining the mixture under mechanical agitation for 4 h, then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$.

Pretreatment

In the same drum in which the pickel was carried out, the pretreatment is carried out by adding, still at 20° C., the following:

Seritol 82 1% maintaining the mixture under agitation for 20 minutes at 20° C.; when this period of time has elapsed, the tanning is carried out.

Tanning:

The following are added, in the same drum:

Ammonium titanyl double sulfate (monohydrate), 22–23%. in $TiO_2$ 6%

Detagil CT 0.1% , maintaining the mixture for 3 h under mechanical agitation; when this period of time has elapsed, the following controls are performed:

pH in the bath: 1.1–1.2;

presence of titanium in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

Basification:

Again in the same drum, the following are added in successive portions:

Mg oxide 0.21%

Anhydrous citric acid 0.03%

Sodium formate 0.06% maintaining the first portion under agitation for two hours and the second, in the same quantity, for three hours.

When this period of time has elapsed, the following controls are performed:

pH of the bath: 2.8–2.9;

absence of precipitates in the bath (visual inspection);

absence of titanium in the form of Ti(+4) in the bath (coloration with hydrogen peroxide).

The following is then added:

Granofin A 1–3% maintaining the mixture under mechanical agitation for 90 minutes at 20° C.;

when this period of time has elapsed, a pH control is performed by adding:

Sodium formate to bring the pH to a value of 3.9–4.0.

The remaining operations were carried out as in Example 1 (for the comparison between the results, see Table 1).

EXAMPLE 4

Pickel:

The following are added to the drum containing the delimed and soaked skins:

Water 100%

Sodium chloride 10% and the mixture is maintained at 20° C. for 20 minutes under mechanical agitation; a density control is performed, which must be approximately 1.0545–1.0584 g/cm$^3$.

The following are then added, in the same drum:

Formic acid (1:10) 0.8% while still maintaining the mixture at 20° C. for 60 minutes; the following is then added:

Sulfuric acid (1:10) 1.4% maintaining the mixture under mechanical agitation for 4 h, then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$.

Pretreatment

In the same drum in which the pickel was carried out, the pretreatment is carried out by adding, still at 20° C., the following:

Anhydrous citric acid 0.5%

Anhydrous sodium sulfate 0.5%

Phosphoric ester 1% (seritol 82)

Sodium hexametaphosphate 1–2% and maintaining the mixture under mechanical agitation for 60 minutes; when this period of time has elapsed, the tanning is carried out. The control which is performed at this stage is a pH control by adding:

Sulfuric acid 85% to bring the pH to 2.7–2.9 and maintaining it, after the addition, in mechanical agitation for 20 minutes.

Tanning

The following are added, in the same drum:

Ammonium titanyl double sulfate monohydrate, 22–23% in $TiO_2$ 6%

Detagil CT 0.1% maintaining the mixture for 3 h under mechanical agitation; when this period of time has elapsed, the following controls are performed:

pH in the bath: 1.1–1.2;

presence of titanium in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

Basification:

The following are added in successive portions, again in the same drum:

Mg oxide 0.21%

Anhydrous citric acid 0.03%

Sodium formate 0.06% maintaining the first portion in agitation for two hours and the second, in the same quantity, for three hours. When this period of time has elapsed, the following controls are performed:

pH of the bath: 2.8–2.9;

absence of precipitates in the bath (visual inspection);

absence of titanium in the form of Ti(+4) in the bath (coloration with hydrogen peroxide).

The following is then added:

Sodium hexametaphosphate 0.5% maintaining the mixture under mechanical agitation for 4 h, then undisturbed for 10 h; when this period of time has elapsed, a pH control is performed, which must continue to be between 3.8 and 3.9 and the detection of a uniform coloration with hydrogen peroxide throughout the cross section of the skin; then the drum is discharged and the "wet-white" skins are maintained undisturbed in a humid environment for at least 48 h. The remaining operations were carried out as in Example 1 (for the comparison between the results, see Table 1).

EXAMPLE 5

Pickel:

The following are added to the drum containing the delimed and soaked skins:

Water 100%

Sodium chloride 10%

Sodium hexametaphosphate 2% and the mixture is maintained at 20° C. for 20 minutes under mechanical agitation; a density control is performed, which must be approximately 1.0545–1.0584 g/cm$^3$.

The following is then added, in the same drum:

Formic acid (1:10) 0.8% still maintaining the mixture at 20° C. for 60 minutes, after which the following are added:

Sulfuric acid (1:10) 1.6%

Anhydrous citric acid 0.5%

Anhydrous sodium sulfate 0.5%

Sodium hexametaphosphate 1% maintaining the mixture under mechanical agitation for 4 h, and then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$.

The remaining operations were carried out as in Example 1 (for the comparison between the results, see Table 1).

EXAMPLE 6

Pickel:

The following are added to the drum containing the delimed and soaked skins:

Water 100%

Sodium chloride 10% and the mixture is maintained at 20° C. for 20 minutes under mechanical agitation; a density control is performed, which must be approximately 1.0545–1.0584 g/cm$^3$.

The following is then added, in the same drum:

Formic acid (1:10) 0.8% still maintaining the mixture at 20° C. for 60 minutes, after which the following is added:

Sulfuric acid (1:10) 1.4% maintaining the mixture under mechanical agitation for 4 h, and then leaving it in an undisturbed bath for 10 h; when this period of time has elapsed, a pH control is performed, which must continue to be between 2.7 and 2.9 and a density control is performed, which must be within the range between 1.0432 and 1.0507 g/cm$^3$. At this stage, some of the bath is discharged, proceeding in such a manner that approximately 15–20% of the initial liquid continues to be present in the drum.

Pretreatment

In the same drum in which the pickel was carried out, the pretreatment is carried out by adding, still at 20° C., the following:

Anhydrous citric acid 0.5%

Anhydrous sodium sulfate 0.5%

Seritol 82 1% and maintaining the mixture under mechanical agitation for 20 minutes; when this period of time has elapsed, the tanning is carried out.

Tanning:

The following are added, in the same drum:

Ammonium titanyl double sulfate monohydrate 6%

Detagil CT 0.1% maintaining the mixture for 3 h under mechanical agitation; when this period of time has elapsed, the following controls are performed:

pH in the bath: 1.1–1.2;

presence of titanium in the form of Ti(+4) in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

Basification:

The following are added in successive portions, again in the same drum:

Mg oxide 0.35%

Anhydrous citric acid 0.05%

Sodium formate 0.1% in agitation for 2 h

Mg oxide 0.21%

Anhydrous citric acid 0.03%

Sodium formate 0.06% in agitation for 3 h.

When this period of time has elapsed, the following controls are performed:

pH of the bath: 2.8–2.9;

absence of precipitates in the bath (visual inspection); absence of titanium in the form of Ti(+4) in the bath (coloration with hydrogen peroxide).

The following are then added:

Sodium formate 0.5%

Water 50% maintaining the mixture under mechanical agitation for 4 h, and then undisturbed for 10 h; when this period of time has elapsed, a pH control is performed, which must be 3.3–3.5 and the detection of a uniform coloration, with hydrogen peroxide, throughout the cross section of the skin, and then the drum is discharged and the "wet-white" skins are maintained undisturbed in a humid environment for at least 48 h.

EXAMPLE 7

The procedure is performed as seen in Example 1, as far as the tanning phase, which will be modified thus:

Tanning:

The following are added, in the same drum:

Ammonium titanyl double sulfate monohydrate 6%

Detagil CT 0.1% maintaining the mixture for 3 h under mechanical agitation; when this period of time has elapsed, the following is added:

Aluminum salt ($Al_2O_3$ content 22–23%) 3% maintaining the mixture under mechanical agitation for 3 h at 20° C.; when this period of time has elapsed, the following controls are performed:

pH in the bath: 1.1–1.2;

presence of titanium in the form of Ti(+4) in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

Basification:

The following are added in successive portions, again in the same drum:

Mg oxide 0.35%

Anhydrous citric acid 0.05%

Sodium formate 0.1% in agitation for 2 h

Mg oxide 0.21%

Anhydrous citric acid 0.03%

Sodium formate 0.06% in agitation for 3 h.

When this period of time has elapsed, the following controls are performed:

pH of the bath: 2.8–2.9;

absence of precipitates in the bath (visual inspection);

absence of titanium in the form of Ti(+4) in the bath (coloration with hydrogen peroxide).

The following is then added:

Sodium formate 0.5% maintaining the mixture under mechanical agitation for 60 minutes, and the following is added:

Sodium bicarbonate 0.5% (1:10) by weight in cold water in a period of time of approximately 1 h, maintaining the mixture for 4 h in agitation and subsequently undisturbed for a further period of 5 h.

When this period of time has elapsed, a pH 3.8–4.0 control is performed and a uniform coloration is detected with hydrogen peroxide throughout the cross section of the skin, and then the drum is discharged and the "wet-white" skins are maintained undisturbed in a humid environment for at least 48 h.

The remaining operations were carried out as in Example 1 (for the comparison between the results, see Table 1).

EXAMPLE 8

The process is identical with that previously described using the aluminum salts, but makes use of basic zirconium sulfate having a $ZrO_2$ content of approximately 22% in a quantity of 2%.

When this period of time has elapsed, the following controls are performed:

pH in the bath: 1.1–1.2;

presence of titanium in the form of Ti(+4) in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

EXAMPLE 9

Pickel:

The following are added to the drum containing the delimed and soaked skins:

Water 100%

Sodium chloride 10% the mixture is maintained at 20° C. for 20 minutes under mechanical agitation;

a density control is performed, which must be approximately 1.0545–1.0584 g/cm$^3$.

The following is then added, in the same drum:

Formic acid (1:10) 0.8% still maintaining the mixture at 20° C. for 60 minutes, and then the following is added:

Sulfuric acid 85% (1:10) 1.8% still maintaining the mixture at 20° C. under mechanical agitation for 4 h, and then leaving it in an undisturbed bath for 10 h; when this period of time has elapsed, a pH control is performed, which must continue to be between 2.7 and 2.9, and a density control is performed, which must be within the range between 1.0432 and 1.0507 g/cm$^3$.

Pretreatment

In the same drum in which the pickel was carried out, the pretreatment is carried out by adding, still at 20° C., the following:

Anhydrous citric acid 0.5%

Anhydrous sodium sulfate 0.5%

Seritol 82 1%

Phthalic anhydride 1% maintaining the mixture under mechanical agitation for 30 minutes; when this period of time has elapsed, the tanning is carried out. The control which is performed at this stage is a pH control and, in fact, the following is added:

Sulfuric acid 85% to reach a pH value of 2.6–2.9. The mixture is further maintained under agitation for 30 minutes at 20° C. All the operations are carried out as set forth in Example 1 (for the comparison of the results, see Table 1).

EXAMPLE 10

Pickel:

The following are added to the drum containing the delimed and soaked skins:

Water 100%

Sodium chloride 10% and the mixture is maintained at 20° C. for 20 minutes under mechanical agitation; a density control is performed, which must be approximately 1.0545–1.0584 g/cm$^3$.

The following are then added, in the same drum:

Anhydrous citric acid 1%

Anhydrous sodium sulfate 1% still maintaining the mixture at 20° C. for 60 minutes, then the following is added:

Sulfuric acid 85% (1:10) 1.6% maintaining the mixture under mechanical agitation for 4 h, and then leaving it in an undisturbed bath for 10 h; when this period of time has elapsed, a pH control is performed, which must continue to be between 2.7 and 2.9, and a density control is performed, which must be within the range between 1.0432 and 1.0507 g/cm$^3$.

Pretreatment

In the same drum in which the pickel was carried out, the pretreatment is carried out by adding, still at 20° C., the following:

Seritol 82 1% maintaining the mixture under agitation for 20 minutes at 20° C.; when this period of time has elapsed, the tanning is carried out.

Tanning

The following are added, in the same drum:

Ammonium titanyl double sulfate monohydrate 6%

Detagil CT 0.1% maintaining the mixture for 3 h under mechanical agitation; when this period of time has elapsed, the following controls are performed:

pH in the bath: 1.1–1.2;

presence of titanium in the form of Ti(+4) in the skin cross section (coloration with hydrogen peroxide);

absence of precipitate of $Ti(OH)_4$ in the tanning bath (visual inspection);

presence of titanium in the form of Ti(+4) in the bath (coloration with hydrogen peroxide).

If the values are within the standard limits, the fixing is undertaken.

Basification

The following are added in successive portions, again in the same drum:

Mg oxide 0.35%

Anhydrous citric acid 0.05%

Sodium formate 0.1% in agitation for 2 h

Mg oxide 0.21%

Anhydrous citric acid 0.03%

Sodium formate 0.06% in agitation for 3 h.

When this period of time has elapsed, the following controls are performed:

pH of the bath: 2.8–2.9;

absence of precipitates in the bath (visual inspection);

absence of titanium in the form of Ti(+4) in the bath (coloration with hydrogen peroxide).

The following is then added:

Phthalic anhydride 1% maintaining the mixture under mechanical agitation for 90 minutes at 20° C.; when this period of time has elapsed, a pH control is performed by adding:

Sodium formate to bring the pH to a value of 3.9–4.0.

The remaining operations were carried out as in Example 1 (for the comparison between the results, see Table 1).

EXAMPLE 11

Pickel:

The following are added to the drum containing the delimed and soaked skins:

Water 100%

Sodium chloride 10% and the mixture is maintained at 35° C. for 20 minutes under mechanical agitation; a density control is performed, which must be approximately 1.0545–1.0584 g/cm$^3$.

The following is then added, in the same drum:

Formic acid (1:10) 0.8% still maintaining the mixture at 35° C. for 60 minutes; the following is then added:

Sulfuric acid (1:10) 1.4% maintaining the mixture under mechanical agitation for 4 h, and then leaving it in an undisturbed bath for 10 h; when this period of time has elapsed, a pH control is performed, which must continue to be between 2.7 and 2.9, and a density control is performed, which must be within the range between 1.0432 and 1.0507 g/cm3o Pretreatment In the same drum in which the pickel was carried out, the pretreatment is carried out by adding, still at 35° C., the following:

Anhydrous citric acid 1%
Anhydrous sodium sulfate 1%
Phosphoric ester=Seritol 82 1.5% and maintaining the mixture under mechanical agitation for 20 minutes; when this period of time has elapsed, the tanning is carried out.

Tanning:

In the same drum, the following are added:
Ammonium titanium double sulfate 6%
Detagil CT 0.1% maintaining the mixture for 3 h under mechanical agitation; when this period of time has elapsed, the following controls are performed:
pH in the bath: 1.1–1.2;
presence of titanium in the form of Ti(+4) in the skin cross section (coloration with hydrogen peroxide);
absence of precipitate of $Ti(OH)_4$ in the tanning bath (visual inspection);
presence of titanium in the form of Ti(+4) in the bath (coloration with hydrogen peroxide).
If the values are within the standard limits, the fixing is undertaken.

Basification:

The following are added in successive portions, again in the same drum:
Mg oxide 0.28%
Anhydrous citric acid 0.04%
Sodium formate 0.08% in agitation for 1.5 h
Gliceroil 101 0.2% (an emulsifiable synthetic oil from Hyspano Quimica for reducing rubbing or friction)
Mg oxide 0.14%
Anhydrous citric acid 0.02%
Sodium formate 0.04% in agitation for 2 h and again, in the same quantity, in agitation for a further period of 2 h.
When this period of time has elapsed, the following controls are performed:
pH of the bath: 2.8–2.9;
absence of precipitates in the bath (visual inspection);
absence of titanium in the form of Ti(+4) in the bath (coloration with hydrogen peroxide).
The following is then added:
Sodium formate 0.5%
Water 50% at a temperature of 10° C. maintaining the mixture under mechanical agitation for 4 h, and then undisturbed for 10 h; when this period of time has elapsed, a pH 3.3–3.5 control is performed and a uniform coloration is detected with hydrogen peroxide throughout the cross section of the skin, and then the drum is discharged and the "wet-white" skins are maintained undisturbed in a humid environment for at least 48 h.

The remaining operations were carried out as in Example 1 (for the comparison between the results, see Table 1).

It is possible to perform this Example in outdoor installations.

EXAMPLE 12

In this Example there is no pickel phase, but the delimed and soaked skins simply undergo a pretreatment of preparation for tanning:

Pretreatment:

The following are added to the initial drum:
Water 30%
Benzenesulfonic acid 0.16%
Sodium bisulfate 0.045%
Ammonium sulfate 0.18%
Sodium bisulfite 0.3% maintaining the mixture under mechanical-agitation for 3 h; when this period of time has elapsed, the following is added:
Formic acid 1%, and the mixture is left under agitation for 6 h, and then undisturbed for 5 h. At this point, a pH control is performed, which must continue to be between 2.5 and 2.6.
The following are added:
Anhydrous citric acid 0.5%
Anhydrous sodium sulfate 0.5%
Seritol 82 2% and the mixture is left under agitation for 20 minutes at 20° C. When this period of time has elapsed, the tanning is undertaken in accordance with what has been seen in Example 1.

Basification:

The following are added in successive portions, again in the same drum:
Mg oxide 0.35%
Anhydrous citric acid 0.05%
Sodium formate 0.1% in agitation for 2 h
Mg oxide 0.21%
Anhydrous citric acid 0.03%
Sodium formate 0.06% in agitation for 3 h.
When this period of time has elapsed, the following controls are performed:
pH of the bath: 2.8–2.9;
absence of precipitates in the bath (visual inspection);
absence of titanium in the form of Ti(+4) in the bath (coloration with hydrogen peroxide)
The following is then added:
Sodium formate 1% maintaining the mixture under mechanical agitation for 4 h, and then undisturbed for 10 h; when this period of time has elapsed, a pH 3.3–3.5. control is performed and a uniform coloration is detected with hydrogen peroxide throughout the cross section of the skin, and then the drum is discharged and the "wet-white" skins are maintained undisturbed in a humid environment for at least 48 h.
The remaining operations were carried out as in Example 1 (for the comparison between the results, see Table 1).

TABLE 1

| Ex. No. | 1 | 2 | 3 | 4 | 5 | 6 | 7 | 8 | 9 | 10 | 11 | 12 |
|---|---|---|---|---|---|---|---|---|---|---|---|---|
| Tg | 75 | 78–82 | 78–82 | 80 | 80 | 75 | 85–88 | 85–90 | 75 | 75 | 75 | 75 |

I claim:

1. A process for tanning skins using a titanium based treatment, comprising the steps of:

(a) tanning said skins with a titanium-based compound in a percentage between 5 and 10% by weight with respect to the pelt weight of the skins;

(b) basifying the tanned skins;

(c) storing the skins;

(d) samming the skins so as to remove water therefrom, and shaving the skins;

(e) adding an organic acid buffer and a salt, selected from the group consisting of sodium salts and potassium salts, to the sammed and shaved skins, and agitating the skins with the added salt;

(f) adding water to the skins in an amount such as to be completely absorbed by the previously sammed and shaved skins; and (g) re-tanning the skins.

2. The process as claimed in claim 1, wherein the skins are subjected to pickling before the tanning.

3. The process as claimed in claim 1, wherein the titanium based compound is used in a percentage of approximately 6% by weight with respect to the pelt weight of the skins.

4. The process as claimed in claim 1, wherein the titanium-based compound is ammonium titanyl double sulfate monohydrate.

5. The process as claimed in claim 1, wherein said salt is selected from the group consisting of sodium sulfate, potassium sulfate, sodium chloride, potassium chloride, a sodium organic salt and a potassium organic salt.

6. The process claimed in claim 2, wherein:

the skins are delimed and soaked before pickling;

the delimed and soaked skins are placed in a drum; and then said pickling, tanning, and basification steps are carried out in succession in said drum.

7. The process as claimed in claim 1, wherein a pre-treatment of the skins is performed before the tanning step, the pre-treatment being the addition of an oily product to the skins.

8. The process as claimed in claim 1, wherein a pre-treatment of the skins is performed before the tanning step, the pre-treatment being the addition of an oily product, a tanning agent, and a masking product to the skins.

9. The process as claimed in claim 8, wherein the tanning agent is non-metallic, the masking product is citric acid, and the oily product is a phosphoric ester and wherein sodium sulfate is further added during the pre-treatment.

10. The process as claimed in claim 8, wherein the tanning agent is an oxazolidine.

11. The process as claimed in claim 10, wherein the oxazolidine is a 7a-ethyldihydro-1H,3H,5H-oxazole (3,4) oxazole.

12. The process as claimed in claim 1, wherein the tanning step is performed in a bath at a pH between approximately 1.0 to 1.3.

13. The process as claimed in claim 1, wherein the basification step includes:

(a) a first basification step at a pH range between 2.7 to 2.9;

(b) a second basification step at a pH range between 3.2 to 4.0.

14. The process as claimed in claim 13, wherein sodium formate is added during the first or second basification step.

15. The process as claimed in claim 1, wherein during the basification step a sodium salt of a weak acid selected from the group consisting of monocarboxylic acid, dicarboxylic acid, and polycarboxylic acid is added in order to avoid or to limit the separation of titanium in the form of hydroxide.

16. The process as claimed in claim 8, wherein during the basification step a sodium salt of a weak acid selected from the group consisting of monocarboxylic acid, dicarboxylic acid, and polycarboxylic acid is added in order to avoid or to limit the separation of titanium in the form of hydroxide.

17. A process for tanning skins using a titanium based treatment, comprising the steps of:

(a) deliming and soaking the skins;

(b) pickling with salts in strong inorganic acids, and organic acids selected from the group consisting of sulfonic organic acids and carboxylic organic acids;

(c) pre-treating the skins after pickling and before tanning with an oily product selected from the group consisting of cationic oils, sulfochlorides, and phosphoric esters;

(d) tanning the skins with ammonium titanyl double sulfate monohydrate in an amount between 5% and 10% with respect to the weight of the pelt skins, at a pH range between 1.0 and 1.3;

(e) basifying the skins at a pH range between 2.7 and 2.9, with a basifying agent selected from the group consisting of magnesium oxide, ion exchange resins, and dolomite as a first step, and then adding to said basifying agent an organic acid buffer so as to basify the skins to a pH between 3.2 and 4 as a second step;

(f) storing the skins for approximately 30 to 50 hours;

(g) samming and shaving the skins;

(h) treating the sammed and shaved skins with a salt, selected from the group consisting of sodium salts and potassium salts, in the presence of an organic acid buffer;

(i) adding water to the skins in an amount such as to be completely absorbed by the previously sammed and shaved skins;

(j) re-tanning the skins using a tanning agent selected from the group consisting of metallic tanning agents, synthetic tanning agents, vegetable tanning agents, and combinations thereof; and (k) finishing by a conventional method.

18. The process as claimed in claim 17, wherein the tanning is performed with an amount of ammonium titanyl double sulfate monohydrate of approximately 6% by weight with respect to the weight of the pelt skins.

19. The process as claimed in claim 17, wherein after pickeling the skins are pretreated before tanning with an oily product, a tanning agent, and a masking product; the tanning agent being selected from the group consisting of metallic tanning agents and synthetic tanning agents; the masking product being selected from the group consisting of polyphosphates, monocarboxylic organic acids, dicarboxylic organic acids, polycarboxylic organic acids, and anhydrides of monocarboxylic, dicarboxylic and polycarboxylic acids.

20. A process for tanning skins using a titanium-based treatment, comprising the steps of:

(a) deliming and soaking the skins;

(b) pickling with salts in strong inorganic acids and organic acids selected from the group consisting of sulfonic organic acids and carboxylic organic acids;

(c) tanning the skins at a pH range between 1.0 and 1.3 with ammonium titanyl double sulfate monohydrate in an amount between 5% and 10% with respect to the weight of the pelt skins, and with an oily product selected from the group consisting of cationic agents, sulfochlorides, and phosphoric esters;

(d) basifying the skins at a pH range between 2.7 and 2.9, with a basifying agent selected from the group consisting of magnesium oxide, ion exchange resins, and dolomite as a first step, and then adding to said basifying agent an organic acid buffer so as to basify the skins to a pH between 3.2 and 4 as a second step;

(e) storing the skins for approximately 30 to 50 hours;

(f) samming and shaving the skins;

(g) treating the sammed and shaved skins with a salt selected from the group consisting of sodium salts and potassium salts in the presence of an organic acid buffer;

(h) adding water to the skins in an amount such as to be completely absorbed by the previously sammed and shaved skins;

(i) re-tanning the skins using a tanning agent selected from the group consisting of metallic tanning agents, synthetic tanning agents, vegetable tanning agents, and combinations thereof; and (j) finishing by a conventional method.

21. The process as claimed in claim 20, wherein the tanning is performed with an amount of ammonium titanyl double sulfate monohydrate of approximately 6% by weight with respect to the weight of the pelt skins.

22. The process as claimed in claim 20, wherein the tanning is carried out in the presence of a masking product selected from the group consisting of polyphosphates, monocarboxylic organic acids, dicarboxylic organic acids, polycarboxylic organic acids, and anhydrides of monocarboxylic, dicarboxylic and polycarboxylic acids.

* * * * *